US008181360B2

(12) United States Patent
Kita et al.

(10) Patent No.: US 8,181,360 B2
(45) Date of Patent: May 22, 2012

(54) SOLE STRUCTURE FOR A SHOE

(75) Inventors: Kenjiro Kita, Ikoma-gun (JP); Kazuhiko Suzuki, Wakayama (JP); Toshiya Horioka, Osaka (JP)

(73) Assignee: Mizuno Corporation, Osaka-shi (JP)

( * ) Notice: Subject to any disclaimer, the term of this patent is extended or adjusted under 35 U.S.C. 154(b) by 559 days.

(21) Appl. No.: 12/381,597

(22) Filed: Mar. 12, 2009

(65) Prior Publication Data

US 2009/0241377 A1 Oct. 1, 2009

(30) Foreign Application Priority Data

Mar. 31, 2008 (JP) ..... 2008-91781
Feb. 9, 2009 (JP) ..... 2009-27224

(51) Int. Cl.
*A43B 13/18* (2006.01)

(52) U.S. Cl. ..... 36/25 R; 36/30 R; 36/28

(58) Field of Classification Search ..... 36/25 R, 36/30 R, 27, 28, 35 R, 114
See application file for complete search history.

(56) References Cited

U.S. PATENT DOCUMENTS

| | | | | |
|---|---|---|---|---|
| 5,279,051 | A * | 1/1994 | Whatley | 36/25 R |
| 5,343,639 | A * | 9/1994 | Kilgore et al. | 36/29 |
| 6,457,261 | B1 | 10/2002 | Crary | |
| 6,487,796 | B1 | 12/2002 | Avar et al. | |
| 6,769,202 | B1 | 8/2004 | Luthi et al. | |
| 6,931,765 | B2 | 8/2005 | Lucas et al. | |
| 7,484,317 | B2 * | 2/2009 | Kita et al. | 36/27 |
| 7,513,065 | B2 * | 4/2009 | Kita et al. | 36/27 |
| 7,546,695 | B2 * | 6/2009 | Aveni et al. | 36/28 |
| 7,624,515 | B2 * | 12/2009 | Kita et al. | 36/30 R |
| 7,673,397 | B2 * | 3/2010 | Jarvis | 36/28 |
| 7,707,743 | B2 | 5/2010 | Schindler et al. | |
| 7,886,461 | B2 * | 2/2011 | Sato | 36/27 |
| 8,056,264 | B2 | 11/2011 | Sato et al. | |
| 2004/0049946 | A1 | 3/2004 | Lucas et al. | |
| 2006/0137227 | A1 | 6/2006 | Kita et al. | |
| 2006/0265902 | A1 * | 11/2006 | Kita et al. | 36/12 |
| 2006/0283045 | A1 * | 12/2006 | Kita et al. | 36/28 |
| 2007/0028484 | A1 * | 2/2007 | Akhidime | 36/28 |
| 2007/0256326 | A1 * | 11/2007 | Jarvis | 36/28 |
| 2008/0034615 | A1 | 2/2008 | Nishiwaki et al. | |
| 2008/0052965 | A1 | 3/2008 | Sato | |
| 2009/0133290 | A1 * | 5/2009 | Kawai | 36/107 |
| 2009/0241370 | A1 | 10/2009 | Kimura | |
| 2009/0241371 | A1 | 10/2009 | Kimura | |
| 2009/0241373 | A1 | 10/2009 | Kita et al. | |

FOREIGN PATENT DOCUMENTS

| | | |
|---|---|---|
| JP | 9-248203 | 9/1997 |
| WO | WO 2006/129837 | 12/2006 |

* cited by examiner

*Primary Examiner* — Marie Patterson
(74) *Attorney, Agent, or Firm* — W. F. Fasse

(57) ABSTRACT

A sole structure 1 for a shoe comprises an upper plate 2 that is disposed on the upper side of the structure 1 and that has upraised portions 20 projecting upwardly form opposite side edge portions of the upper plate 2, a lower plate 3 disposed below the upper plate 2, and a plurality of longitudinally separated connecting portions 4, 5 and 6 that are disposed between the upper plate 2 and the lower plates 3 to form voids 10 therebetween and that elastically connect the upper plate 2 with the lower plate 3. The upper end of the connecting portion 5 extends upwardly to the side surface of the upraised portion 20 of the upper plate 2 and a projecting portion 5*b* that projects in the longitudinal direction is provided at the extension 5*a*. The extension 5*a* and the projecting portion 5*b* are fixedly attached to the side surface of the upraised portion 20.

14 Claims, 14 Drawing Sheets

SOLE STRUCTURE FOR A SHOE

BACKGROUND OF THE INVENTION

The present invention relates generally to a sole structure for a shoe, and more particularly, to an improved sole structure for improving cushioning properties, causing a smooth ride feeling, and improving a lateral stability during walking or running.

We proposed a sole structure such as shown in WO 2006/129837. The sole structure is comprised of an upper plate, a wavy corrugated lower plate disposed under the upper plate and having two bulges to form a void with the upper plate, and an elastic block to couple an upwardly convex portion formed between the adjacent bulges to the upper plate.

Also, Japanese patent application laying-open publication No. 9-248203 (JP 9-248203) shows a midsole structure comprised of a dispersion portion formed of synthetic resin and disposed on the upper side of the structure, a ground contact portion disposed on the lower side of the structure, and a buffer portion formed of a plurality of longitudinally continuous V-shaped portions and disposed between the dispersion portion and the ground contact portion. An upper end of each of the V-shaped portions extends to a side edge portion of the dispersion portion.

In the above-mentioned sole structure shown in WO 2006/129837, at the time of a shoe strike onto the ground, each of the bulges of the lower plate compressively deforms into a more flattened shape and the void between the upper and lower plates thus functions as a cushioning hole to absorb an impact load.

Also, in this case, the elastic block shearing-deforms in the longitudinal direction during walking or running and the upper plate thus sways to and fro. Thereby, a smooth ride feeling can be achieved.

However, in the sole structure like this, when the shoe impacts the ground, the elastic block is so constructed as to shearing-deforms not only in the longitudinal direction but also in the lateral direction. As a result of this, depending on the rigidity of the elastic block, the upper plate may sway in the lateral direction at the time of the shoe strike onto the ground.

On the other hand, the above-mentioned JP 9-248203 describes that an impact load applied to the ground contact portion at the time of the shoe strike onto the ground is dispersed at each of the V-shaped portions of the buffer portion and transmitted to the dispersion portion and the cushioning properties thus improves.

Also, in this case, since the upper end of each of the V-shaped portions extends to the side edge portion of the dispersion portion, it may be possible that a lateral sway at the time of the shoe strike onto the ground is prevented in some degree.

However, in the midsole structure like this, each of the V-shaped portions is structured such that it is hard to be shearing-deformed in the longitudinal direction because the buffer portion is formed of a plurality of longitudinally continuous V-shaped portions and the upper end of each of the V-shaped portions is fixed to the dispersion portion. Thereby, the dispersion portion disposed on the upper side cannot sway to and fro during walking or running and as a result a smooth ride feeling cannot be achieved.

The present invention is directed to providing a sole structure for a shoe that can improve cushioning properties, that can provide a smooth ride feeling, and that can improve stability in the lateral direction.

Other objects and advantages of the present invention will be obvious and appear hereinafter.

SUMMARY OF THE INVENTION

A sole structure for a shoe according to a first aspect of the present invention comprises an upper plate disposed on an upper side of the sole structure, a lower plate disposed below the upper plate, and a plurality of connecting portions that are disposed and longitudinally separated between the upper plate and the lower plates to form a void therebetween and that elastically connect a bottom surface of the upper plate with a top surface of the lower plate. An upper end of the connecting portion extends upwardly over the bottom surface of the upper plate to a side surface of the upper plate and is fixed to the side surface of the upper plate.

According to the first aspect of the present invention, when the shoe impacts the ground, the void formed between the upper plate and the lower plate compressively deforms to act as a cushion hole, thus absorbing an impact load.

In this case, since the connecting portions that connect the upper and lower plates are formed of a plurality of longitudinally separated members, the connecting portions are easy to shearing-deform in the longitudinal direction. Thereby, during walking or running, the connecting portions shearing-deform moderately in the longitudinal direction and the upper plate sways to and fro. As a result, a smooth ride feeling can be achieved during walking or running.

Also, since the upper end of the connecting portion extends to the side surface of the upper plate and its extension is fixed to the side surface of the upper plate, at the time of the shoe impact onto the ground, a rolling of the upper plate in the lateral direction due to a shearing deformation of the connecting portion in the lateral direction can be restricted by the extension of the connecting portion. Thereby, stability of the sole structure in the lateral direction can be improved.

The upper plate may have an upraised portion projecting upwardly from a side edge portion of the upper plate, the upper end of the connecting portion extending upwardly to the side surface of the upraised portion and being fixed to the side surface of the upraised portion.

In this case, since a large area of an upward extension of the upper end of the connecting portion that restricts a rolling of the upper plate is allowed, an action that restricts a rolling of the upper plate in the lateral direction can be increased. At the same time, since a large area for fixing between the upper end of the connecting portion and the side surface of the upraised portion can be secured, a fixing strength can be improved to enhance durability.

The upper end of the connecting portion may have a projecting portion that projects in the longitudinal direction at the side surface of the upper plate or the upraised portion.

In this case, since a much larger area of the upward extension of the upper end of the connecting portion that restricts a rolling of the upper plate is allowed, a rolling of the upper plate in the lateral direction can be securely restricted. At the same time, since a much larger area for fixing between the upper end of the connecting portion and the side surface of the upraised portion can be secured, a fixing strength can be further improved.

The connecting portion may be a T-shaped member in a side view. In this case, the upper end of the connecting portion projects toward the front side as well as the rear side at the side of the upper plate or the upraised portion.

The upper ends of the connecting portions may be connected to each other in the longitudinal direction at the side surface of the upper plate or the upraised portion.

In this case, since the upper ends of the adjacent connecting portions are connected to each other in the longitudinal direction and thus an area of an extension of the upper end of the connecting portion that restricts a rolling of the upper plate can be further enlarged, a rolling of the upper plate in the lateral direction can be more securely restricted. At the same time, since a still further larger area for fixing between the upper end of the connecting portion and the side surface of the upraised portion can be secured, a fixing strength can be still further improved.

A sole structure for a shoe according to a second aspect of the present invention comprises an upper plate disposed on an upper side of the sole structure, a lower plate disposed below the upper plate, and a plurality of connecting portions that are disposed and longitudinally separated between the upper plate and the lower plate to form a void therebetween and that elastically connect a bottom surface of the upper plate with a top surface of the lower plate. A lower end of the connecting portion extends downwardly over the top surface of the lower plate to a side surface of the lower plate and is fixed to the side surface of the lower plate.

According to the second aspect of the present invention, when the shoe impacts the ground, the void formed between the upper plate and the lower plate compressively deforms to act as a cushion hole, thus absorbing an impact load.

In this case, since the connecting portions that connect the upper and lower plates are formed of a plurality of longitudinally separated members, the connecting portions are easy to shearing-deform in the longitudinal direction. Thereby, during walking or running, the connecting portions shearing-deform moderately in the longitudinal direction and the upper plate sways to and fro. As a result, a smooth ride feeling can be achieved during walking or running.

Also, since the lower end of the connecting portion extends downwardly to the side surface of the lower plate and a downward extension is fixed to the side surface of the lower plate, at the time of the shoe impact onto the ground, a rolling of the upper plate in the lateral direction due to a shearing deformation of the connecting portion in the lateral direction can be restricted by the downward extension of the connecting portion. Thereby, stability of the sole structure in the lateral direction can be improved.

The lower end of the connecting portion may have a projecting portion that projects in the longitudinal direction at the side surface of the lower plate.

In this case, since an area of a downward extension of the lower end of the connecting portion that restricts a rolling of the upper plate is further enlarged, a rolling of the upper plate in the lateral direction can be securely restricted. At the same time, since a larger area for fixing between the lower end of the connecting portion and the side surface of the lower plate can be secured, a fixing strength can be further improved.

The lower ends of the connecting portions may be connected to each other in the longitudinal direction at the side surface of the lower plate.

In this case, since the lower ends of the adjacent connecting portions are connected to each other in the longitudinal direction and thus an area of a downward extension of the lower end of the connecting portion that restricts a rolling of the upper plate is further enlarged, a rolling of the upper plate in the lateral direction can be more securely restricted. At the same time, since a much larger area for fixing between the lower end of the connecting portion and the side surface of the lower plate is secured, a fixing strength can be further improved.

An outsole may be provided on a bottom surface of the lower plate, the outsole extending upwardly over the side surface of the lower plate, the downwardly extension of the connecting portion being integral with an upward extension of the outsole.

In this case, since the connection portion is integral with the outsole, the rigidity of the connecting portion is increased, thereby surely regulating a rolling of the upper plate in the lateral direction to further improve a lateral stability of the sole structure.

The connecting portion may be formed of a pillar-shaped member extending in an upward and downward direction between the upper plate and the lower plate, the connecting portion being disposed on a medial side or a lateral side of the sole structure.

In the event that the connecting portion is located on the medial side of the sole structure, a rolling of the upper plate toward the medial side can be effectively restricted. Also, in the event that the connecting portion is located on the lateral side of the sole structure, a rolling of the upper plate toward the lateral side can be effectively restricted.

The connecting portion may be formed of a pillar-shaped member extending in an upward and downward direction between the upper plate and the lower plate, the connecting portion being disposed both on the medial side and on the lateral side of the sole structure.

In this case, a rolling of the upper plate toward both the medial side and the lateral side can be effectively restricted.

The connecting portion may extend along the entire width of the sole structure.

In this case, the rigidity of the entire connecting portion is increased, thus more surely regulating a rolling of the upper plate in the lateral direction to further improve a lateral stability of the sole structure.

The upper plate may have a convexed and concaved shape of a downwardly convexedly curved portion and an upwardly convexedly curved portion that are disposed alternately, the connecting portion being provided at the downwardly convexedly curved portion of the upper plate.

The lower plate may have a convexed and concaved shape of a downwardly convexedly curved portion and an upwardly convexedly curved portion that are disposed alternately, the connecting portion being provided at the upwardly convexedly curved portion of the lower plate.

An outsole may be provided on a bottom surface of the lower plate, the outsole having an extension that extends upwardly at a rear end of a heel region of the sole structure, the connecting portion that elastically connects between the upper plate and the lower plate and that forms a void between the upper plate and the lower plate at the rear end of the heel region of the sole structure being formed of the extension of the outsole.

In this case, since the connecting portion at the rear end of the heel region is integrated with the outsole, the rigidity of the connecting portion is increased, thereby enlarging an effect that restricts a rolling of the upper plate in the lateral direction to improve a lateral stability of the sole structure and enhancing durability of the connecting portion at the rear end of the heel region.

BRIEF DESCRIPTION OF THE DRAWINGS

For a more complete understanding of the invention, reference should be made to the embodiments illustrated in greater detail in the accompanying drawings and described below by way of examples of the invention. In the drawings, which are not to scale.

DETAILED DESCRIPTION OF THE PREFERRED EMBODIMENTS

Figure 1A:
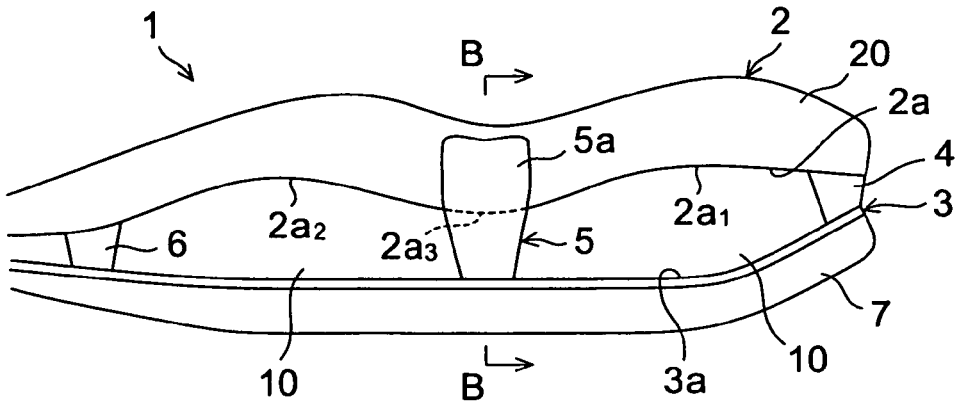
FIG. 1A is an enlarged side view of a sole structure for a shoe according to a first embodiment of the present invention.
Figure 1B:
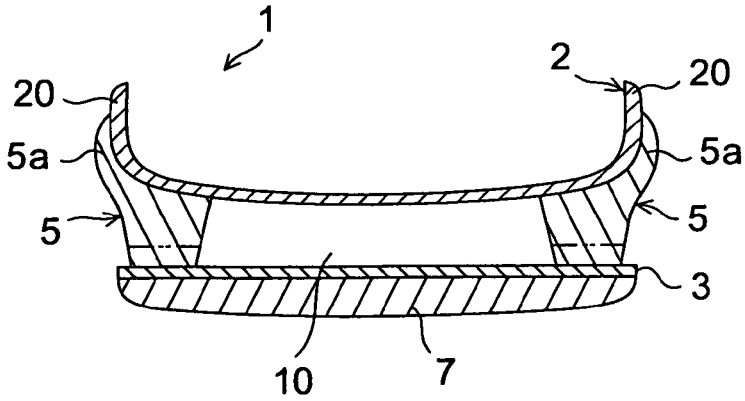
FIG. 1B is a cross sectional view of FIG. 1A taken along line B-B.
Figure 2A:
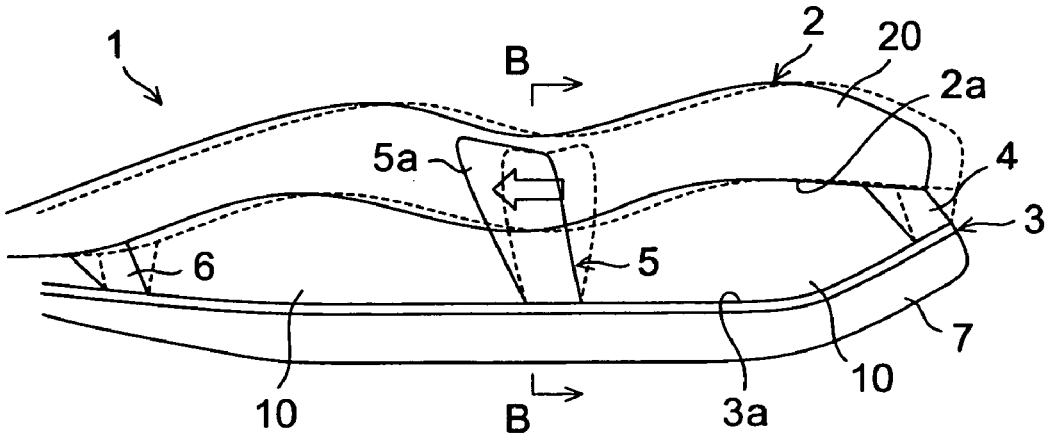
FIG. 2A illustrates the state in which the sole structure of FIG. 1 has swayed toward the front side.
Figure 2B:
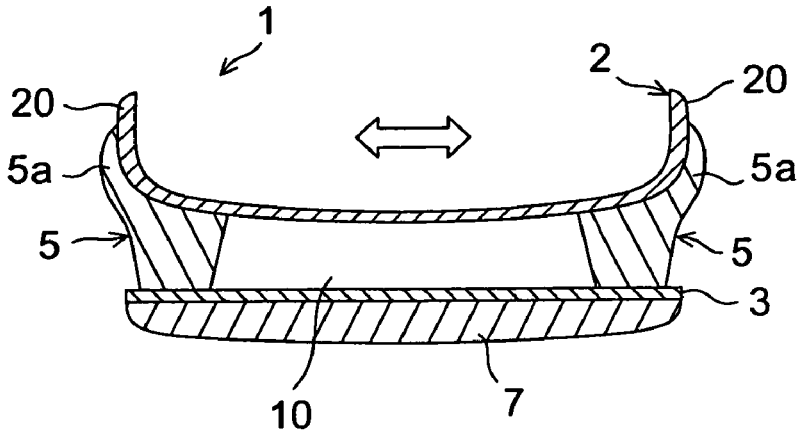
FIG. 2B is a cross sectional view of FIG. 2A taken along line B-B.

Referring now to the drawings, FIGS. 1 and 2 show a sole structure or a sole assembly for a shoe according to a first embodiment of the present invention. In these drawings, like reference numbers indicate identical or functionally similar elements. Also, in FIG. 2A, a dotted line designates a state before deformation, which corresponds to FIG. 1A.

As shown in FIG. 1, a sole structure 1 comprises an upper plate 2 disposed on an upper side of the sole structure 1, a lower plate 3 disposed below the upper plate 2, a plurality of connecting portions 4, 5, 6 that are disposed and longitudinally (i.e. the left to right direction in FIG. 1A) separated between the upper plate 2 and the lower plate 3 to form a void 10 therebetween and that elastically connect a bottom surface 2*a* of the upper plate 2 with a top surface 3*a* of the lower plate 3. In this example, the bottom surface 2*a* of the upper plate 2 has a convexed and concaved shape formed of two upwardly convexedly curved portions $2a_1$, $2a_2$, and a downwardly convexedly curved portion $2a_3$ located between the upwardly convexedly curved portions $2a_1$, $2a_2$. Also, the top surface 3*a* of the lower plate 3 is generally flat-shaped except that the rear end portion of the heel region is inclined upwardly. Below the lower plate 3 is provided an outsole 7.

Preferably, the upper plate 2 has a pair of upraised portions 20 that project upwardly from opposite side edge portions of the upper plate 2. Also, the upraised portion of the heel region of the upper plate 2 projects upwardly from not only the opposite side edge portions but also the rear end edge portion and the heel region is thus a heel-cup-shaped region. An inside surface of the upraised portion 20 is adapted to be fixedly attached to a bottom portion of an upper (not shown) of a shoe. A portion of an upper end of the connecting portion 5 extends upwardly to a side surface of the upraised portion 20 over the bottom surface 2*a* of the upper plate 2 and an upward extension 5*a* of the connecting portion 5 is fixedly attached (e.g. bonded) to the side surface of the upraised portion 20.

In this example, the upward extension is provided only at the connecting portion 5, but the remaining connecting portions 4, 6 may also have upward extensions at their upper ends, which are fixed to the side surface of the upraised portion.

Each of the connecting portions 4, 5, 6 is formed of a pillar-shaped member extending in the upper and lower direction between the upper plate 2 and the lower plate 3. The connecting portion 4 is provided singly at the rearmost end edge portion of the heel region, a pair of (i.e. two) connecting portions 5 are provided at the side edge portions on the medial side and the lateral side of a longitudinally central portion (i.e. at the position of the downwardly convexedly curved portion $2a_3$) of the heel region, and a pair of (i.e. two) connecting portions 6 are provided at the side edge portions on the medial side and the lateral side of a front end portion of the heel region.

Each of the connecting portions 4, 5, 6, in FIG. 1, has a truncated cone shape except the upward extension. However, the shape of each of the connecting portions 4, 5, 6 is not limited to such a shape. An inverted truncated cone shape that is upside down relative to the truncated cone shape of FIG. 1 is applicable. Alternatively, a prism-shaped i.e. a square-shaped pillar, or any other shape may be employed.

The upper plate 2 and the lower plate 3 are preferably resin-made. As applicable resin materials, for example, thermoplastic resin such as thermo plastic polyurethane (TPU), polyamide elastomer (PAE) and the like are used. Thermosetting resin such as epoxy resin, unsaturated polyester resin and the like are also used. Furthermore, it is also possible to form the upper and lower plates 2, 3 integrally with each other using ethylene-vinyl acetate copolymer (EVA), rubber or the like.

The connecting portions 4, 5, 6 are formed of elastic materials. As applicable elastic materials, for example, thermoplastic resin such as ethylene-vinyl acetate copolymer (EVA) or the like, foamed thermoplastic resin, thermosetting resin such as polyurethane (TPU) or the like, foamed thermosetting resin, or rubber materials such as butadiene rubber, chloroprene rubber or the like, or foamed rubber materials may be used. Preferably, the connecting portions 4, 5, 6 are formed of materials of a low elasticity and a low hardness relative to the upper and lower plates 2, 3.

At the time of a shoe strike onto the ground, when the outsole 7 of the sole structure 1 contacts the ground, the void 10 formed between the upper plate 2 and the lower plate 3 compressively deforms so as to act as a cushion hole, thus absorbing a shock load.

At this juncture, since the connecting portions 4, 5, 6 to connect between the upper and lower plates 2, 3 are formed of a plurality of longitudinally separated pillar-shaped members, the connecting portions 4, 5, 6 are so constructed as to shearing-deform with ease in the longitudinal direction. Thereby, during walking or running, each of the connecting portions 4, 5, 6 shearing-deforms moderately toward the front side (i.e. the arrow marked direction of FIG. 2A) and the upper plate 2 thus sways toward the front side (see a solid line of FIG. 2A). As a result, a smooth ride feeling can be achieved during walking or running.

On the other hand, at the time of the shoe strike onto the ground, even if a roll of the upper plate 2 is about to occur in the lateral direction (i.e. the left to right direction of FIG. 2B), since the upper end of the connecting portion 5 extends to the side surface of the upraised portion 20 of the upper plate 2 and the upward extension 5*a* is fixed to the side surface of the upraised portion 20, the roll of the upper plate 2 in the lateral direction due to the shearing-deformation of connecting portion 5 in the lateral direction can be restricted by the extension 5*a* of the connecting portion 5. Thereby, stability in the lateral direction can be improved.

Also, in this case, since the upward extension 5*a* of the upper end of the connecting portion 5 is fixed to the side surface of the upraised portion and an area of the extension 5*a* to restrict a rolling of the upper plate 2 is thus increased, an action that regulates the rolling of the upper plate 2 in the lateral direction can be enlarged. At the same time, since a large fixing area can be secured between the upper end of the connecting portion and the side surface of the upraised portion, a fixing strength can be enhanced and durability can be improved. The upper end of the connecting portion 5 may extend upwardly to the side surface of the upper or a midsole above the upper plate 2 over the upraised portion 20 and an upward extension may be fixed to the side surface of the upper or the midsole 2. In this case, the connecting portion can secure a still wider fixing area with the side surface of the upraised portion, or the side surface of the midsole or the upper. Thereby, a fixing strength can be further enhanced and durability can be further improved.

Each of the connecting portions 4, 5, 6 is not necessarily formed of a single element. For example, it may be formed of two regions of an upper and lower region distinguished by a dash-and-dot line in FIG. 1B. Different materials may be used at the two regions (e.g. the upper region is formed of a material of a low hardness and low density, and the lower region of a high hardness and high density) and the two regions may be fixedly attached to each other. In addition, a boundary surface that divides the two regions is not limited to the dash-and-dot line in FIG. 1B.

In this way, by forming the connecting portion of different materials, the rigidity of the connecting portion can be controlled and shearing-deformation of the connecting portion in the forward direction and the lateral direction can thus be controlled in a more minute manner. Thereby, rolling properties of the upper plate in the lateral direction can be restricted, and rolling properties in the forward direction can be adjusted.

Figure 3A:
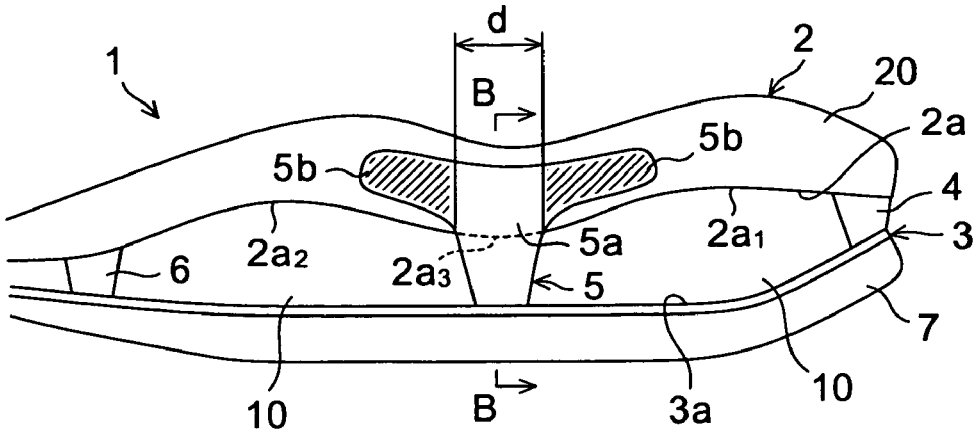
FIG. 3A is an enlarged side view of a sole structure for a shoe according to a second embodiment of the present invention.
Figure 3B:
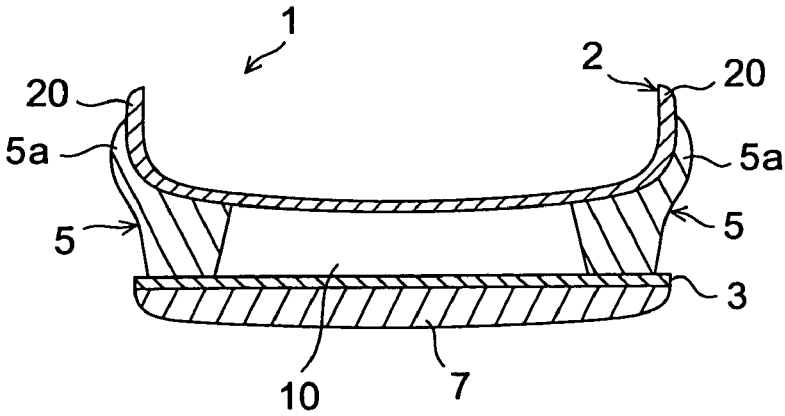
FIG. 3B is a cross sectional view of FIG. 3A taken along line B-B.
Figure 4A:
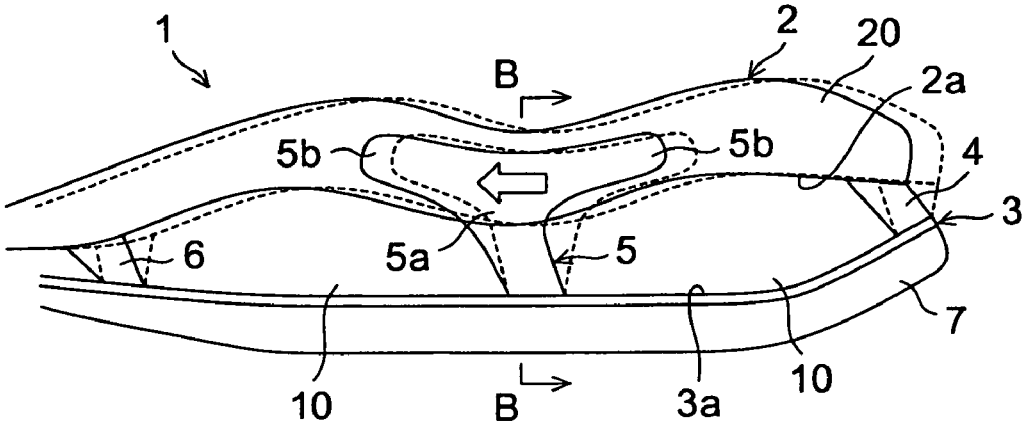
FIG. 4A illustrates the state in which the sole structure of FIG. 3 has swayed toward the front side.
Figure 4B:
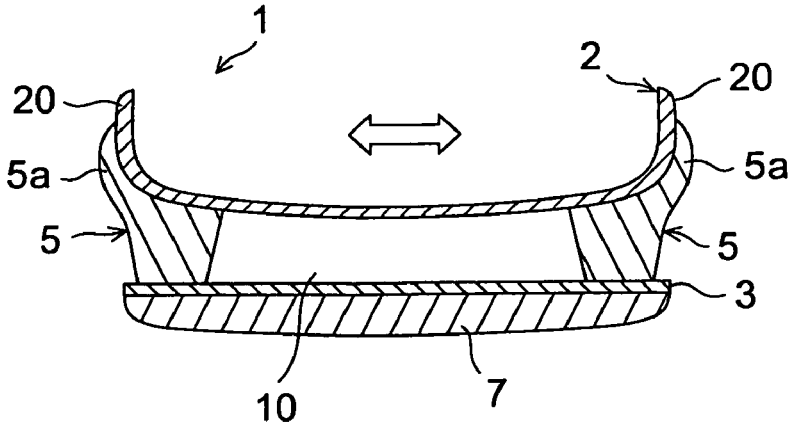
FIG. 4B is a cross sectional view of FIG. 4A taken along line B-B.

FIGS. 3 and 4 show a sole structure or a sole assembly for a shoe according to a second embodiment of the present invention. In these drawings, like reference numbers indicate identical or functionally similar elements. Also, in FIG. 4A, a dotted line designates a state before deformation, which corresponds to FIG. 3A.

The second embodiment differs from the first embodiment in that the extension 5*a* at the upper end of the connecting portion 5 has longitudinally projecting portions 5*b* on the side surface of the upraised portion 20. That is, in this case, the connecting portion 5 is T-shaped in a side view. As shown in FIG. 3A, the longitudinally projecting portions 5*b* are hatched regions that extend from the extension 5*a* (see a longitudinal length d) of the connecting portion 5 toward the front and rear sides.

In this second embodiment as well, similar to the first embodiment, when the shoe impacts the ground the void 10 between the upper and lower plates 2, 3 compressively deforms to absorb an impact load. At this juncture, the connecting portions 4, 5, 6 shearing-deform moderately toward the front side (i.e. the arrow mark direction in FIG. 4A) and the upper plate 2 sways forwardly (see the solid line of FIG. 4A), thus allowing for a smooth ride feeling. Also, at this juncture, since the projecting portions 5*b* of the connecting portion 5 extends in the longitudinal direction, the projecting portions 5*b* do not hinder the motion of the upper plate 2 when the upper plate 2 sways to and fro.

On the other hand, at the time of the shoe strike onto the ground, when the upper plate 2 is about to sway in the lateral direction (i.e. the left to right direction in FIG. 4B), since the extension 5*a* at the upper end of the connecting portion 5 is fixed to the side surface of the upraised portion 20 and besides the projecting portions 5*b* are formed at longitudinally opposite sides of the extension 5*a*, a rolling of the upper plate 2 in the lateral direction due to shearing-deformation of the connecting portion 5 in the lateral direction can be more securely restricted by the extension 5*a* and projecting portions 5*b* of the connecting portion 5. Thereby, a lateral stability can be improved.

Also, in this case, a large fixing area can be secured between the upper end of the connecting portion and the side surface of the upraised portion, thus enhancing a fixing strength and improving the durability. Moreover, in this case, since the upper end of the connecting portion has secured a large fixing area with the upper plate 2, the upper plate 2 is hard to deform at and near the fixing portion with the upper end of the connecting portion, thereby making a shoe wearer feel a less thrust from the connecting portion 5 and preventing the upper end of the connecting portion from peeling off from a lower end of the fixing surface with the upper plate 2.

To contrary, in the above-mentioned first embodiment, since there is not provided a longitudinally projecting portion 5*b* at the extension 5*a* of the upper end of the connecting portion and a fixing area between the upper end of the connecting portion and the side surface of the upraised portion is not so wide, as compared with the second embodiment, the upper plate 2 is easy to deform at and near the fixing portion with the upper end of the connecting portion, thus making a shoe wearer feel a thrust from the connecting portion 5.

In this second embodiment, the connecting portion 5 is T-shaped in a side view by making the projecting portion 5*b* of the connecting portion 5 project both in the forward direction and in the rearward direction on the side surface of the upraised portion, but the connecting portion 5 may be inverted L-shaped in a side view by making the projecting portion 5*b* project either in the forward direction or in the rearward direction.

Also, in this second embodiment, the projecting portion 5*b* is provided only at the extension 5*a* of the connecting portion 5, but the remaining connecting portions 4, 6 may also extend upwardly and at upward extensions may be provided projecting portions. Moreover, in this case, the extensions of the connecting portions 4, 5, 6 may be longitudinally coupled to each other at the side surface of the upraised portion.

In this case, since the upper ends of the adjacent connecting portions 4, 5, 6 are coupled to each other in the longitudinal direction an area of the extensions at the upper end of the connecting portions that restrict a rolling of the upper plate 2 can be further enlarged. Thereby, a rolling of the upper plate 2 in the lateral direction can be more securely restricted. Also, since a still wider fixing area can be secured between the upper end of the connecting portion and side surface of the upraised portion, a fixing strength and durability can be much further improved.

Figure 5A:
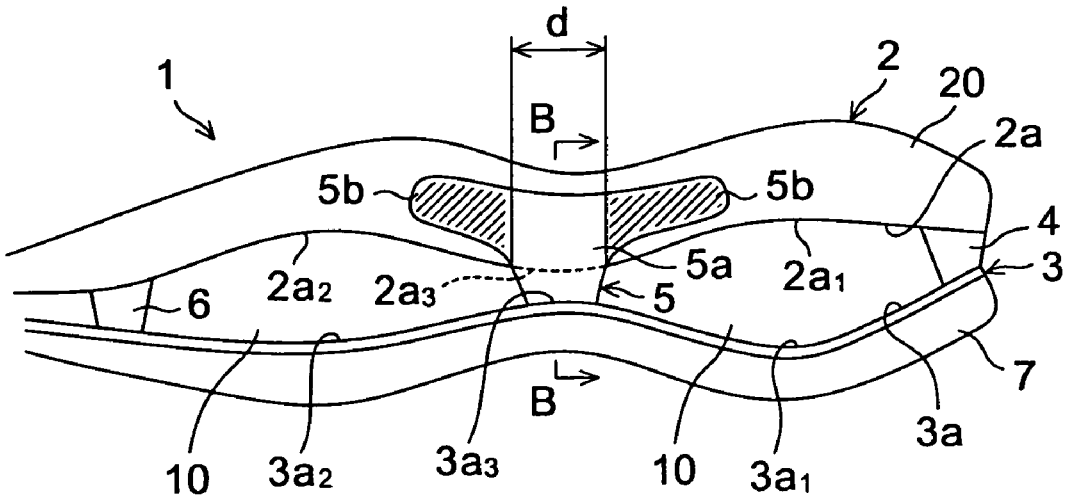
FIG. 5A is an enlarged side view of a sole structure for a shoe according to a third embodiment of the present invention.
Figure 5B:
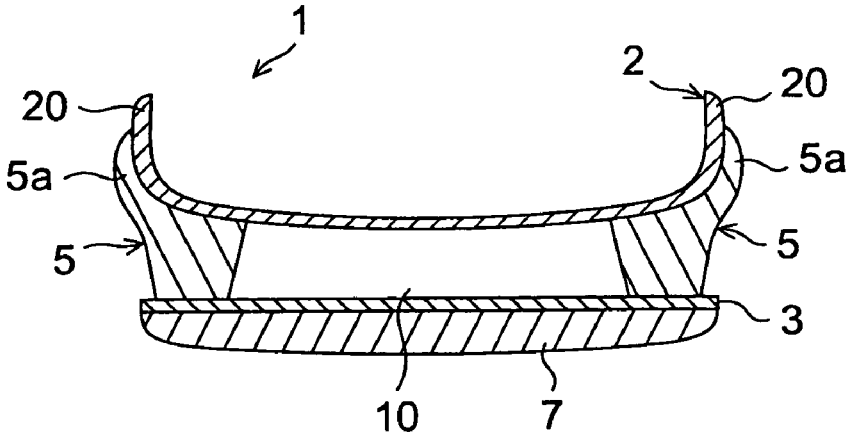
FIG. 5B is a cross sectional view of FIG. 5A taken along line B-B.
Figure 6A:
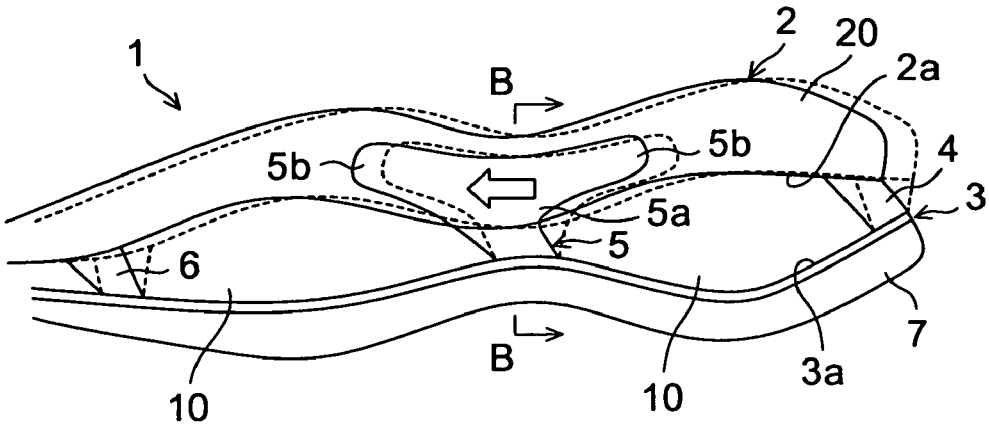
FIG. 6A illustrates the state in which the sole structure of FIG. 5 has swayed toward the front side.
Figure 6B:
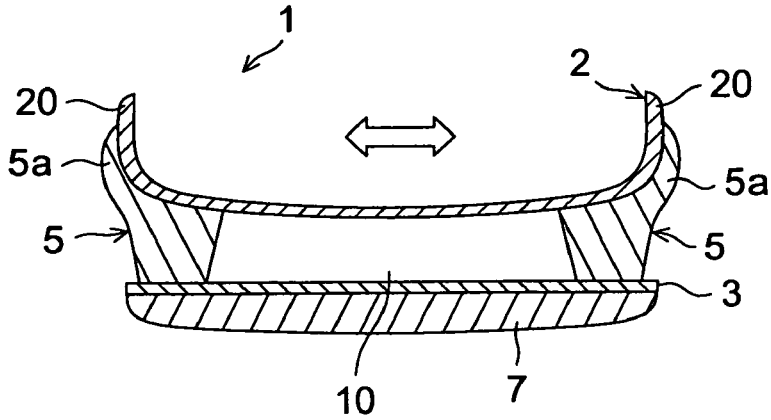
FIG. 6B is a cross sectional view of FIG. 6A taken along line B-B.

FIGS. 5 and 6 show a sole structure or a sole assembly for a shoe according to a third embodiment of the present invention. In these drawings, like reference numbers indicate identical or functionally similar elements. Also, in FIG. 6A, a dotted line designates a state before deformation, which corresponds to FIG. 5A.

In the above-mentioned first and second embodiments, the upper plate 2 was solely convex-and-concave-shaped, but in this third embodiment, both the upper plate 2 and the lower plate 3 are convex-and-concave-shaped. That is, the top surface 3*a* of the lower plate 3 has a convex-and-concave-shape that is formed of two downwardly convexedly curved portions $3a_1$, $3a_2$, and an upwardly convexedly curved portion $3a_3$ disposed between the downwardly convexedly curved portions $3a_1$, $3a_2$. The upwardly convexedly curved portion $3a_3$ of the lower plate 3 is disposed opposite the downwardly convexedly curved portion $2a_3$ of the upper plate 2 and the connecting portion 5 is disposed between the upwardly convexedly curved portions $3a_3$ of the lower plate 3 and the downwardly convexedly curved portions $2a_3$ of the upper plate 2.

In this third embodiment as well, similar to the second embodiment, when the shoe impacts the ground the void 10 between the upper and lower plates 2, 3 compressively deforms to absorb an impact load. In this case, not only the convex-and-concave-shaped surface of the upper plate 2 but also the convex-and-concave-shaped surface of the lower plate 3 deforms into a more flattened shape, thus improving the cushioning properties. Also, at this juncture, the connecting portions 4, 5, 6 shearing-deform moderately toward the front side (i.e. the arrow mark direction in FIG. 6A) and the upper plate 2 sways forwardly (see the solid line of FIG. 6A), thus allowing for a smooth ride feeling.

On the other hand, at the time of the shoe strike onto the ground, when the upper plate 2 is about to sway in the lateral direction (i.e. the left to right direction in FIG. 6B), since the extension 5*a* at the upper end of the connecting portion 5 and the projecting portions 5*b* on the opposite ends of the extension 5*a* are fixed to the side surface of the upraised portion 20, a rolling of the upper plate 2 in the lateral direction due to shearing-deformation of the connecting portion 5 in the lateral direction can be more securely restricted by the extension 5*a* and projecting portions 5*b* of the connecting portion 5. Thereby, a lateral stability can be improved. Also, in this case, since the height of the connecting portion 5 is low between the upper plate 2 and the lower plate 3, a rolling of the upper plate 2 due to shearing-deformation in the lateral direction is hard to occur.

FIG. 7 shows a sole structure or a sole assembly for a shoe according to a fourth embodiment of the present invention. In the drawing, like reference numbers indicate identical or functionally similar elements.

Figure 7A:
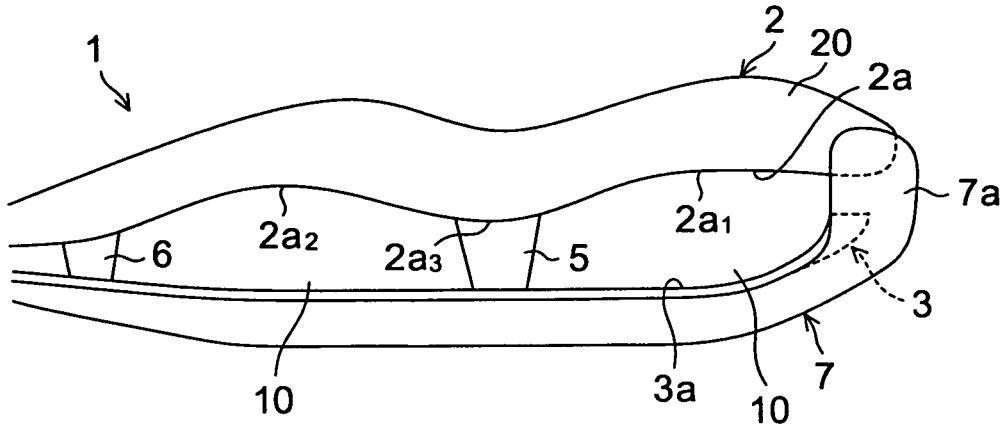
FIG. 7A is an enlarged side view of a sole structure for a shoe according to a fourth embodiment of the present invention.
Figure 7B:
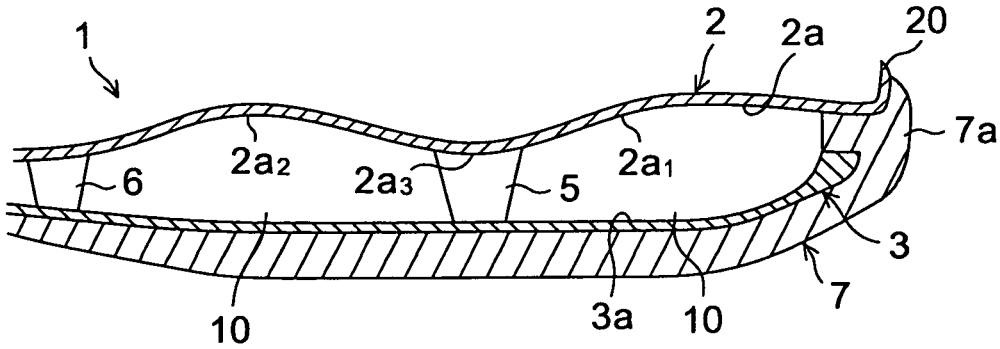
FIG. 7B is a longitudinal sectional view of FIG. 7A taken along the longitudinal centerline.
Figure 7C:
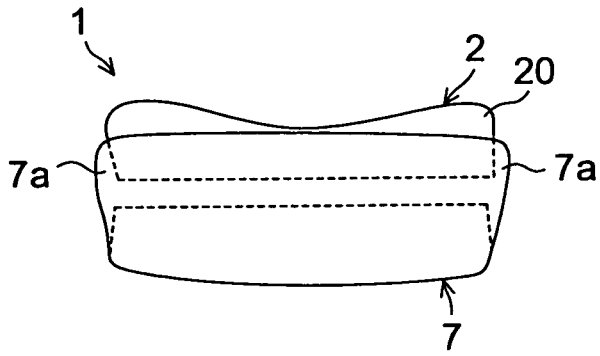
FIG. 7C is a rear end view of the sole structure of FIG. 7A.

In this fourth embodiment, as shown in FIGS. 7A to 7C, an outsole 7 provided on the bottom surface of the lower plate 3 extends upwardly at the rear end of the heel region of the sole structure 1 over the rear end surface of the lower plate 3 and an upward extension 7*a* of the outsole 7 at the rear end of the heel region functions as a connecting portion that elastically couples the upper plate 2 and the lower plate 3. As applicable material for the outsole 7, solid rubber, foamed rubber, or foamed thermoplastic synthetic resin such as EVA or the like can be used.

In this case, since the connecting portion at the heel rear end is integrated with the outsole 7 and the rigidity of the connecting portion is thus enhanced, a rolling of the upper plate 2 in the lateral direction can be more securely restricted, thus further improving a lateral stability. On the other hand, during a prolonged use, the heel rear end part of the sole structure 1 is generally easiest to peel off. However, in this fourth embodiment, the connecting portion of the heel rear end part is integral with the outsole 7, thereby improving a fixing strength and preventing an occurrence of peel-off.

Figure 8A:
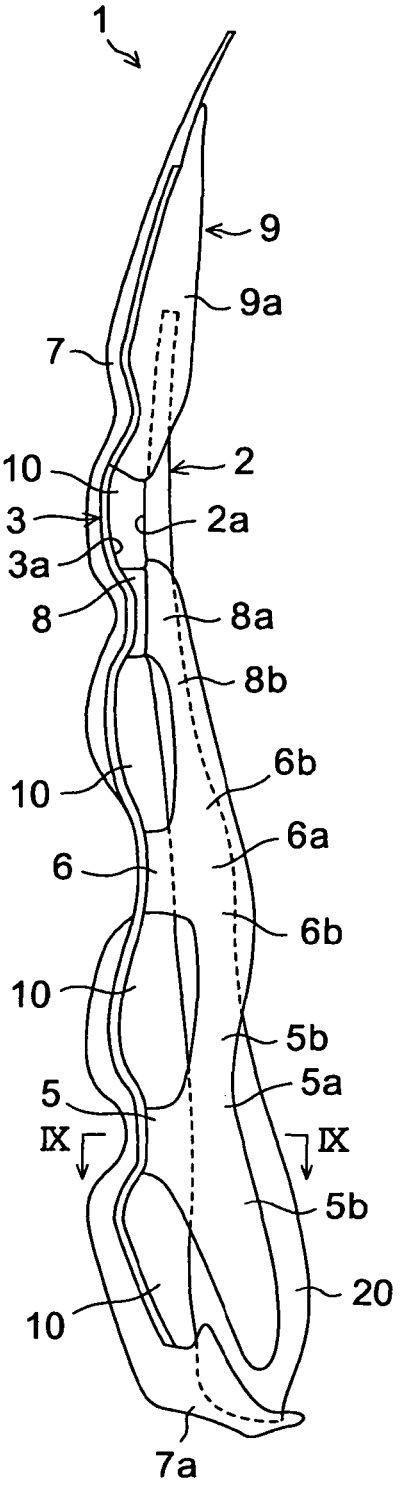
FIG. 8A is a side view of a sole structure for a shoe according to a fifth embodiment of the present invention.
Figure 8B:
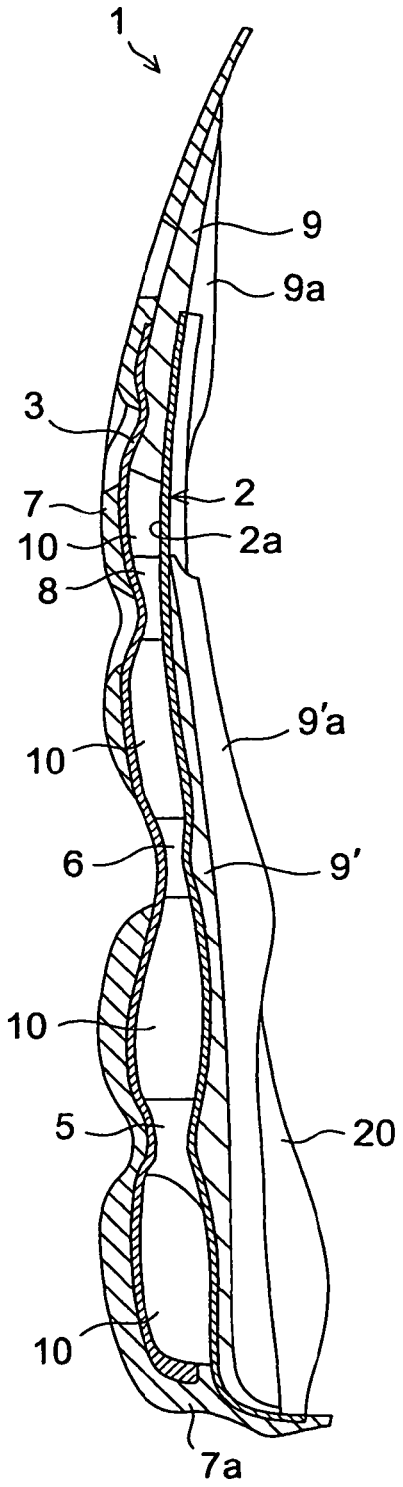
FIG. 8B is a longitudinal sectional view of FIG. 8A taken along the longitudinal centerline.
Figure 9:
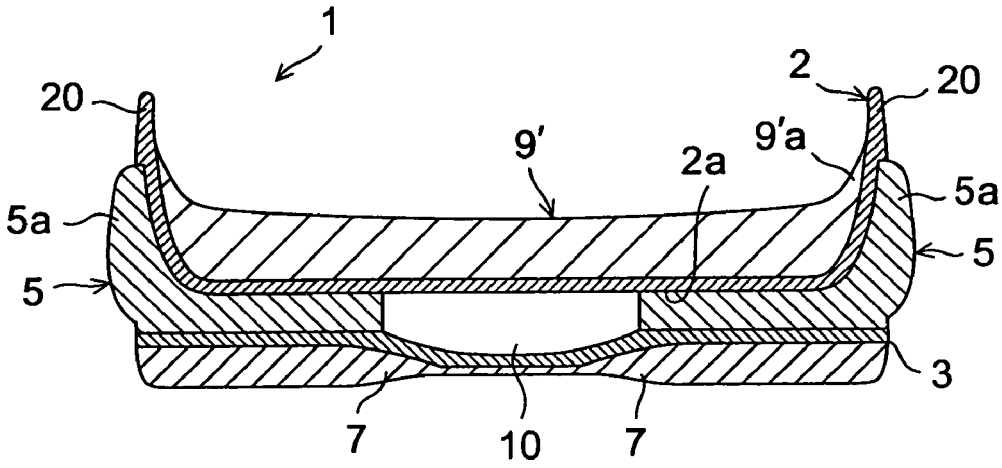
FIG. 9 is a cross sectional view of FIG. 8A taken along line IX-IX.

FIGS. 8 and 9 show a sole structure or a sole assembly for a shoe according to a fifth embodiment of the present invention. In these drawings, like reference numbers indicate identical or functionally similar elements.

In this fifth embodiment, as shown in FIGS. 8A and 8B, the upper and lower plates 2, 3 extend from the heel region to the forefoot region of the sole structure 1. For the connecting portions between the upper plate 2 and the lower plate 3, a connecting portion at the heel rear end is formed of the upward extension 7*a* of the outsole 7. In front of the connecting portion 6 is provided a connecting portion 8 via the void 10. In front of the connecting portion 8 is provided a connecting portion formed of a midsole 9 via the void 10. The midsole 9 elastically interconnects between the upper plate 2 and the lower plate 3 at the forefoot portion of the sole structure 1 and extends to a toe portion of the sole structure 1 over a front end edge of the upper plate 2. Also, from the rear end of the forefoot region to the heel region of the sole structure 1, on the upper plate 2 is provided a midsole 9' (see FIG. 8B). The midsole 9' has an upraised portion 9'*a* extending upwardly (i.e. to the right in FIG. 8B) along the upraised portion 20 of the upper plate 2 (see FIG. 9).

The upward extension 5*a* of the connecting portions and the projecting portion 5*b*, the upward extension 6*a* of the connecting portion 6 and the projecting portion 6*b*, and the upward extension 8*a* of the connecting portion 8 and the projecting portion 8*b* are coupled to and integrated with each other in the longitudinal direction (see FIG. 8B). In addition, the upward extension 6*a* of the connecting portion 6, the projecting portion 6*b*, the upward extension 8*a* of the connecting portion 8, and the projecting portion 8*b* extend upwardly over the upraised portion 20, and these extensions (not shown) are adapted to be fixedly attached to the upper of the shoe.

In this fifth embodiment, when the shoe impacts the ground the void 10 between the upper and lower plates 2, 3 compressively deforms to absorb an impact load. At this juncture, the upward extension 7*a* of the outsole 7, the connecting portions 5, 6, 8, and the midsole 9 between the upper and lower plates 2, 3 shearing-deform moderately toward the front side (i.e. the upper direction in FIG. 8A) and the upper plate 2 sways forwardly, thus allowing for a smooth ride feeling.

On the other hand, at the time of the shoe strike onto the ground, when the upper plate 2 is about to sway in the lateral direction (i.e. perpendicular to FIG. 8A), since the upward extension 7*a* of the outsole 7, the upward extensions 5*a*, 6*a*, 8*a* of the connecting portions 5, 6, 8, and the projecting portions 5*b*, 6*b*, 8*b* are fixedly attached to the side surface of the upraised portion and besides the projecting portions 5*b*, 6*b*, 8*b* are interconnected to and integral with each other in the longitudinal direction, a rolling of the upper plate 2 in the lateral direction can be securely regulated by these upward extensions 5*a*, 6*a*, 7*a*, 8*a*, the projecting portions 5*b*, 6*b*, 8*b*, and longitudinal connecting portions, thus further improving a lateral stability. Additionally, in this case, the side surface of the resin-made upper plate 2 is covered with foamed material such as EVA or the like, which gives an external appearance of the sole structure a soft impression.

In the above-mentioned first to fifth embodiments, the connecting portion was provided at the side edge portions on both the medial side and the lateral side of the sole structure to effectively regulate a rolling of the upper plate toward the medial side and the lateral side, but the present invention is not limited to such an example.

The connecting portion may be provided at the side edge portion on either the medial side or the lateral side of the sole structure 1. For example, in the event that the connecting portion is disposed at the side edge portion on the medial side only, a rolling of the upper plate toward the medial side can be regulated, which contributes to prevent pronation during walking or running. Also, in the event that the connecting portion is disposed at the side edge portion on the lateral side only, a rolling of the upper plate toward the lateral side can be regulated, which contributes to prevent supination during walking or running.

Also, in the above-mentioned embodiments, each of the connecting portions was formed of an upwardly extending pillar-shaped member, but the application of the present is not limited to such an example. The connecting portion may be a bar-shaped member that extends along the entire width (i.e. from the medial side edge portion to the lateral side edge portion) of the sole structure. In this case, the rigidity of the entire connecting portion is increased, thus regulating a rolling of the upper plate in the lateral direction more certainly to further improve a lateral stability.

In the above-mentioned first to fifth embodiments, the upper plate only, or both the upper plate and the lower plate had a convex-and-concave shape, but the present invention also has application to an embodiment in which only the lower plate 3 has a convex-and-concave shape. Moreover, the present invention is also applicable to an embodiment in which both the upper plate 2 and the lower plate 3 are planar in the shape.

In the above-mentioned first to fifth embodiments, an example was shown in which the upper end of the connecting portion to connect the upper and lower plates 2, 3 extends upwardly over the bottom surface 2*a* of the upper plate 2 and the upward extension is fixedly attached to the side surface of the upraised portion of the upper plate 2, but the present invention is not limited to such an example.

The lower end of the connecting portion may extend downwardly over the top surface 3*a* of the lower plate 3 and a downward extension of the connecting portion may be fixedly attached to the side surface of the lower plate 3. Also, in this case, there may be provided a projecting portion to project longitudinally from the downward extension. Moreover, the downward extensions of the connecting portions may be coupled to each other in the longitudinal direction.

In this case as well, at the time of the shoe strike onto the ground, a rolling of the upper plate 2 in the lateral direction due to shearing-deformation of the connecting portion in the lateral direction can be prevented by the downward extension of the connecting portion and/or the projecting portion, thus improving a lateral stability.

In the above-mentioned first to fifth embodiments, there were shown an example in which inner side (in a shoe-width direction) surfaces of the connecting portions 4, 5, 6 extend linearly from the lower plate 3 to the upper plate 2 between the upper and lower plates 2, 3 (see FIGS. 1B, 2B, 3B, 4B, 5B, 6B, and 9), and an example in which a front side (in a longitudinal direction) surface of the connecting portion 4 extend linearly from the lower plate 3 to the upper plate 2 between the upper and lower plates 2, 3 (see FIGS. 1A, 3A, 5A, and 7B), but the present invention is not limited to these examples.

FIG. 10 to 14 show a sole structure according to alternative embodiments of the present invention. Each of the drawings designates a different embodiment. In these drawings, like reference numbers indicate identical or functionally similar elements. Also, in FIGS. 10 and 11, the connecting portion 5 is taken as an example, but it is also applicable to the other connecting portions.

Figure 10:
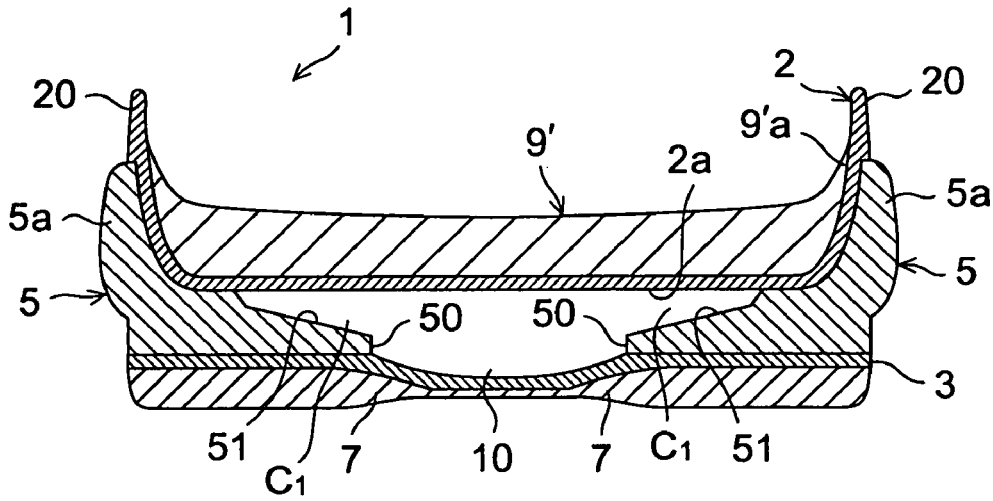
FIG. 10 is a cross sectional view of a sole structure for a shoe according to an alternative embodiment of the present invention, corresponding to FIG. 9 of the fifth embodiment of the present invention.

In FIG. 10, the inner surface (on the heel central side) of the connecting portion 5 is formed of an upwardly extending wall surface 50 generally perpendicular to the lower plate 3, and an inclined surface 51 extending diagonally upwardly toward the outside in the shoe width direction from the upper end of the upwardly extending wall surface 50. That is, in this case, between the bottom surface 2*a* of the upper plate 2 and the inclined surface 51 of the connecting portion 5 is formed a void $C_1$. Thereby, an inner side edge portion of a bonding surface of the connecting portion 5 on the bottom surface 2*a* of the upper plate 2 is disposed at the outer side compared to an inner side edge portion of a bonding surface of the connecting portion 5 on the top surface 3*a* of the lower plate 3.

When the outsole 7 impacts the ground at the time of the shoe strike onto the ground, an upward load applied from the outsole 7 to the sole structure 1 acts onto the upper plate 2 from the lower plate 3 through the connecting portion 5 and then from the upper plate 3 through the midsole 9' to the sole of the shoe wearer's foot.

At this juncture, since a contact point of the connecting portion 5 with the bottom surface 2*a* of the upper plate 2 is located at the outer side (i.e. toward the heel outer circumferential side) apart from the vicinity of the sole center of the shoe wearer's foot, the upward load applied from the ground contact surface to the lower plate 3 can be prevented from directly acting to the vicinity of the center of the upper plate 2 through the connecting portion 5, thereby relieving a thrust to the foot sole of the wearer from the connecting portion 5 at the time of the shoe impact onto the ground. Also, the void $C_1$ formed between the bottom surface 2*a* of the upper plate 2 and the inclined surface 51 of the connecting portion 5 can improve the cushioning properties at the time of the shoe impact onto the ground.

In contrast, according to the first to fifth embodiments, the inner side surfaces (in the shoe width direction) of the connecting portions 4, 5, 6 extend linearly from the lower plate 3 to the upper plate 2 between the upper and lower plates 2, 3 (see FIGS. 1B, 2B, 3B, 4B, 5B, 6B, and 9). In these cases, the upward load applied from the ground to the lower plate 3 at the time of the shoe impact onto the ground directly acts onto the upper plate 2 through the connecting portion 5.

Also, the void $C_1$ formed between the bottom surface 2*a* of the upper plate 2 and the inclined surface 51 of the connecting portion 5 can make the entire sole structure 1 lighter in weight. Moreover, the upper extension 5*a* of the upper end of the connecting portion 5 is fixed to the side surface of the upraised portion 20 of the upper plate 2, thus securing a sufficient fixing strength between the connecting portion 5 and the upraised portion 20.

In this case as well, since the connecting portion 5 has a truncated cone shape in a side view between the upper and lower plates 2, 3 (see FIG. 8), during walking or running the connecting portion 5 shearing-deforms moderately in the forward direction (perpendicular to the page of FIG. 10) and the upper plate 2 sways in the forward direction. Thereby, as with the first to fifth embodiments, a smooth ride feeling can be attained.

Figure 11:
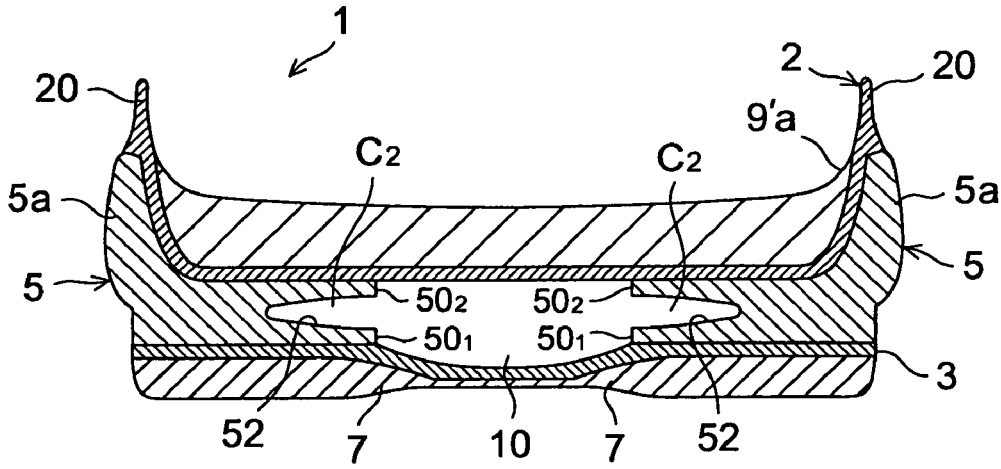
FIG. 11 is a cross sectional view of a sole structure for a shoe according to a further alternative embodiment of the present invention, corresponding to FIG. 9 of the fifth embodiment of the present invention.

In FIG. 11, the inner surface (on the heel central side) of the connecting portion 5 is formed of an upwardly extending wall surface $\mathbf{50}_1$ generally perpendicular to the lower plate 3, a downwardly extending wall surface $\mathbf{50}_2$ generally perpendicular to the upper plate 2, and a generally V-shaped notch 52 formed between the upwardly and downwardly extending wall surfaces $\mathbf{50}_1$ and $\mathbf{50}_2$. That is, in this case, the notch 52 forms a void $C_2$.

When the outsole 7 impacts the ground at the time of the shoe strike onto the ground, the void $C_2$ at the V-shaped notch 52 can prevent the upward load applied from the ground to the lower plate 3 from directly acting to the upper plate 2 through the connecting portion 5, thus relieving a thrust from the connecting portion 5 to the shoe wearer's foot sole at the time of the shoe impact onto the ground. Also, the void $C_2$ can improve the cushioning properties at the shoe impact and also make the entire sole structure lighter in weight. Moreover, in this case as well, since the upward extension 5*a* of the upper end of the connecting portion 5 is fixedly attached to the side surface of the upraised portion 20 of the upper plate 2, a fixing strength between the connecting portion 5 and the upraised portion 20 can be ensured.

Figure 12:
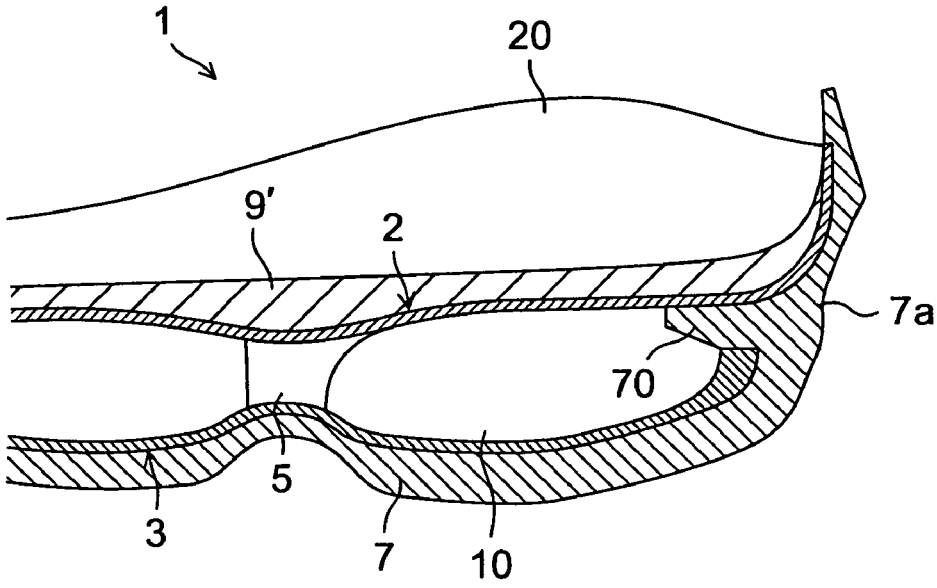
FIG. 12 is a longitudinal sectional view of a sole structure for a shoe according to a still further alternative embodiment of the present invention taken along the longitudinal centerline.

In FIG. 12, an upward extension 7*a* of the outsole 7 provided at the heel rear end of the sole structure 1 has a projecting portion 70 that projects into the void 10 toward the front side of the shoe.

Figure 13:
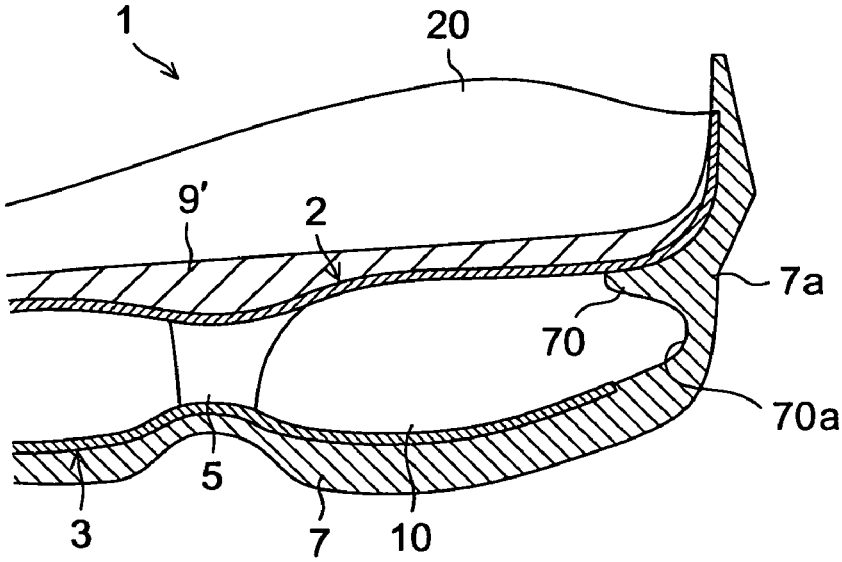
FIG. 13 is a longitudinal sectional view of a sole structure for a shoe according to a still further alternative embodiment of the present invention taken along the longitudinal centerline.

In FIG. 13, the upward extension 7*a* of the outsole 7 has the projecting portion 70 that projects into the void 10 toward the front side of the shoe, and at the lower end of the projecting portion 70 is formed a generally U-shaped curved portion 70*a* extending toward the heel rear end side.

Figure 14:
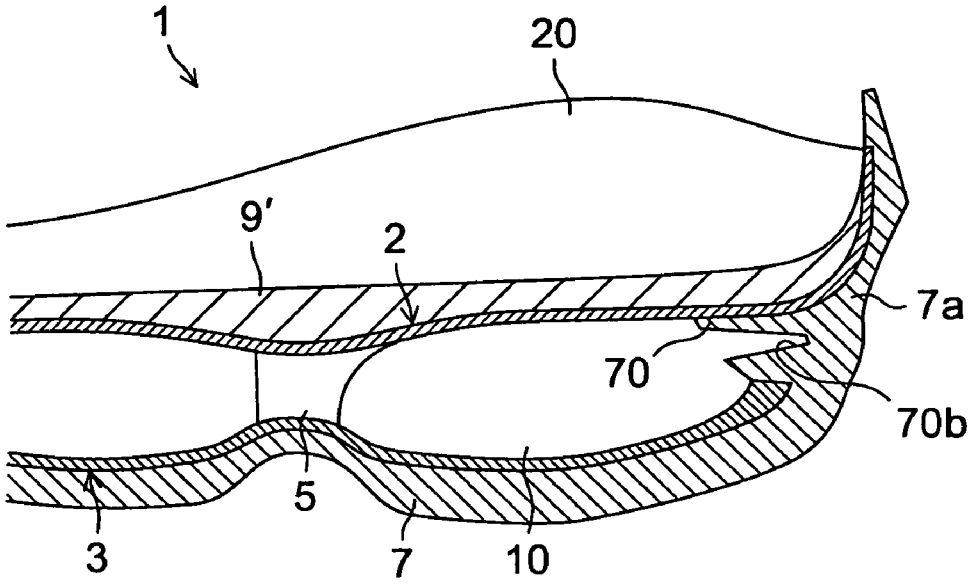
FIG. 14 is a longitudinal sectional view of a sole structure for a shoe according to an additional alternative embodiment 4d of the present invention taken along the longitudinal centerline.

In FIG. 14, the upward extension 7*a* of the outsole 7 has the projecting portion 70 that projects into the void 10 toward the front side of the shoe, and the projecting portion 70 has a generally V-shaped notch 70*b* formed therein and extending toward the heel rear end side.

In the embodiments show in FIGS. 12 to 14, the projecting portion 70 can secure a large fixing surface between the extension 7*a* of the outsole 7 and the upper plate 2. Thereby, when the shoe wearer strikes onto the ground from the heel rear end of the shoe 1 the upward load from the ground through the lower plate 3 to the upper plate 2 can be dispersed by the projecting portion 70, thus mitigating a thrust from the ground on the heel rear end side. Also, in the embodiments shown in FIGS. 13 and 14, the curved portion 70*a* and the notch 70*b* can improve the cushioning properties of the shoe at the shoe impact onto the ground.

Figure 15:
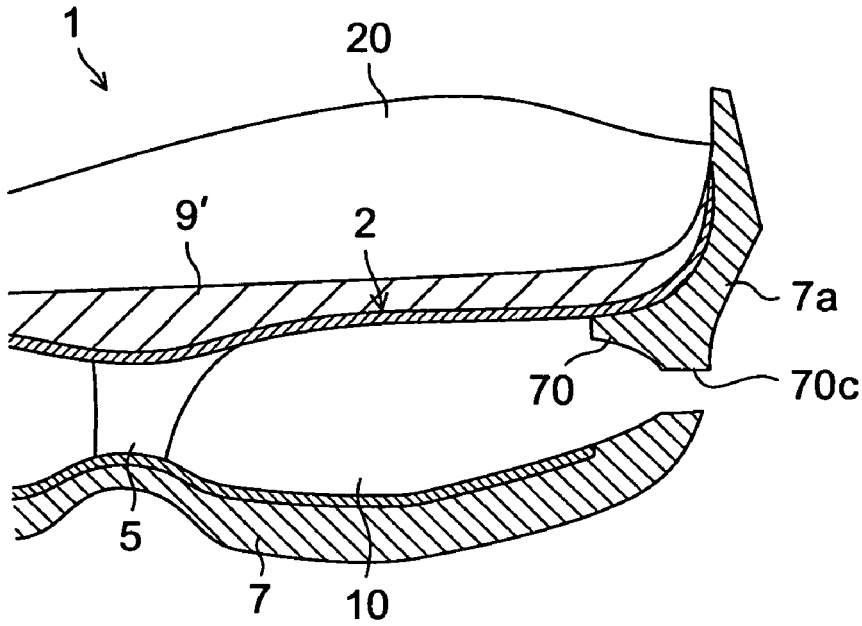
FIG. 15 is a longitudinal sectional view of a sole structure for a shoe according to another alternative embodiment of the present invention taken along the longitudinal centerline.
Figure 16:
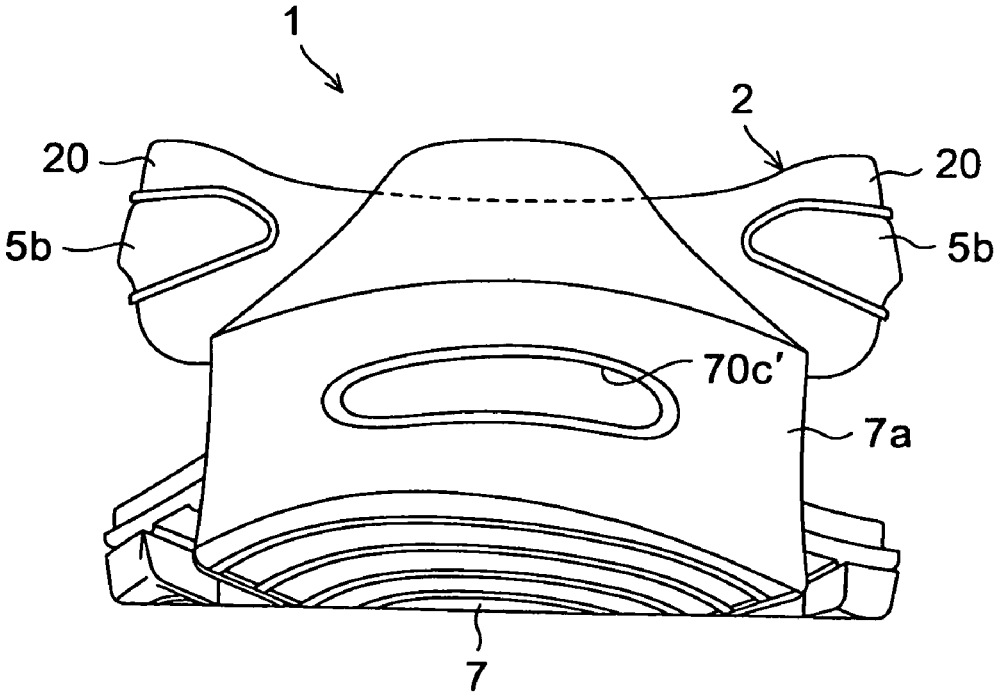
FIG. 16 is a rear view of a sole structure for a shoe according to a still another alternative embodiment of the present invention as viewed from the heel side.
Figure 17:
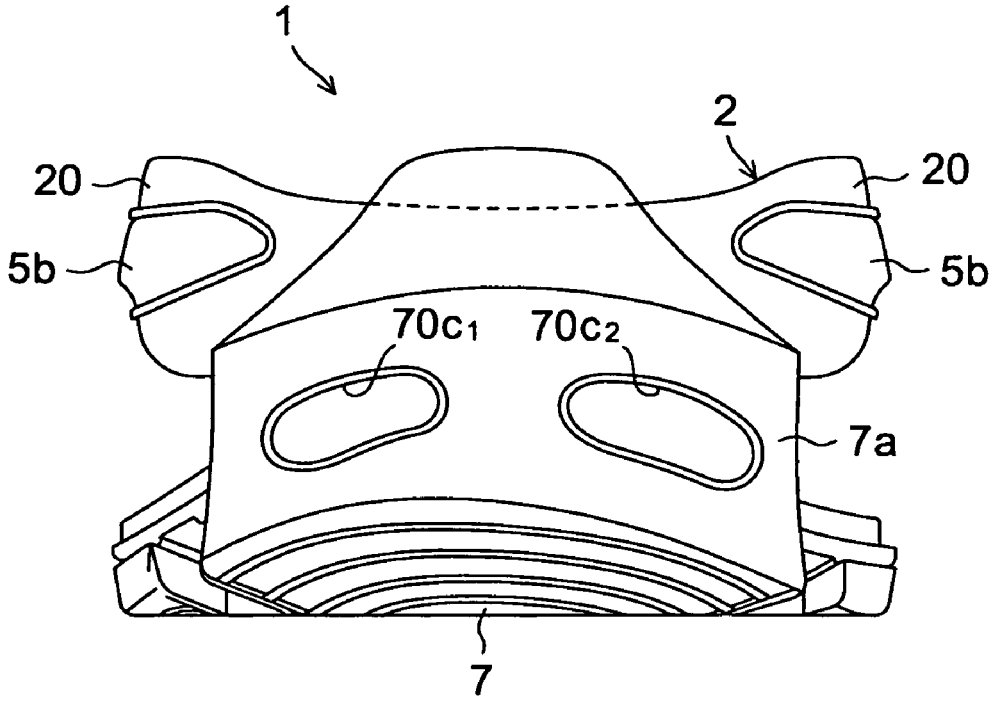
FIG. 17 is a rear view of a sole structure for a shoe according to a further alternative embodiment of the present invention as viewed from the heel side.

FIGS. 15 to 17 show alternative embodiments of the present invention. These drawings designate different embodiments, respectively. In these drawings, like reference numbers indicate identical or functionally similar elements.

In FIG. 15, the extension 7*a* of the outsole 7 has the projecting portion 70 that projects into the void 10 toward the front side of the shoe and below the projecting portion 70 is formed a through hole 70*c* that penetrates the central portion of the heel rear end. The through hole 70*c* has for an example a round cross sectional shape.

In FIG. 16, a through hole 70*c*' that penetrates the central portion of the heel rear end below the projecting portion 70 is an elongated aperture extending in the lateral direction. In FIG. 17, through holes $\mathbf{70}c_1$, $\mathbf{70}c_2$ that penetrate the heel rear end below the projecting portion 70 are provided on opposite sides, respectively, of the central portion of the heel rear end.

According to the embodiments shown in FIGS. 15 to 17, when the shoe 1 impacts the ground on the heel rear end the cushioning properties are improved at the extension 7*a* of the outsole 7 with the through holes to enhance shock absorbing properties at the heel impact. Also, at the extension 7*a* of the outsole 7 without the through holes, as with the first to fifth embodiments, a stability at the heel impact can be secured. Also, through holes can decrease the weight of the sole structure. Moreover, in this case as well, since a boding surface can be secured between the upward extension 7*a* of the outsole 7 and the upraised portion 20 of the upper plate 2, a fixing strength between the upward extension 7*a* of the outsole 7 and the upraised portion 20 can be maintained. In addition, the number of through holes that penetrate the heel rear end at the upward extension 7*a* of the outsole 7 may be three or more.

Those skilled in the art to which the invention pertains may make modifications and other embodiments employing the principles of this invention without departing from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequent, while the invention has been described with reference to particular embodiments and examples, modifications of structure, sequence, materials and the like would be apparent to those skilled in the art, yet fall within the scope of the invention.

What is claimed is:

1. A sole structure for a shoe comprising:

an upper plate disposed on an upper side of said sole structure;

a lower plate disposed on a lower side of said sole structure; and a plurality of connecting members that are separated from one another and are disposed between said upper plate and said lower plate to form a void therebetween, and that elastically connect said upper plate with said lower plate;

wherein an upper end of at least one of said connecting members extends upwardly beyond a bottom surface of said upper plate to a side surface of said upper plate and is fixed to said side surface of said upper plate, and wherein said upper end extends outwardly sideways beyond a base end of said at least one connecting member, which base end is connected to said lower plate.

2. The sole structure according to claim 1, wherein said upper plate has an upraised portion projecting upwardly from a side edge portion of said upper plate, wherein said side surface of said upper plate comprises a side surface of said upraised portion, and wherein said upper end of said at least one of said connecting members extends upwardly to and is fixed to said side surface of said upraised portion.

3. The sole structure according to claim 1, further comprising an outsole provided on a bottom surface of said lower plate, wherein at a rear end of a heel region of said sole structure said outsole has an upward extension that extends upwardly beyond a side surface of said lower plate, and said upward extension constitutes said one of said connecting members.

4. The sole structure according to claim 1, wherein said at least one of said connecting members has a projecting portion at said upper end thereof, and wherein said projecting portion projects in a longitudinal direction along said side surface of said upper plate.

5. The sole structure according to claim 4, wherein said at least one of said connecting members is T-shaped in a side view.

6. The sole structure according to claim 1, wherein at least two of said connecting members are provided and upper ends of said at least two of said connecting members are connected to each other in a longitudinal direction on said side surface of said upper plate.

7. The sole structure according to claim 1, wherein said plurality of connecting members are each formed of a pillar-shaped member that extends in an upward and downward direction between said upper plate and said lower plate and are located on either a medial side or a lateral side of said sole structure.

8. The sole structure according to claim 1, wherein said plurality of connecting members are each formed of a pillar-shaped member that extends in an upward and downward direction between said upper plate and said lower plate and are located on both a medial side and a lateral side of said sole structure.

9. The sole structure according to claim 1, wherein said plurality of connecting members extend along an entire width of said sole structure.

10. The sole structure according to claim 1, wherein said upper plate has a wavy corrugation including a downwardly convex portion and an upwardly convex portion that are disposed alternately in a longitudinal direction, and wherein said one of said connecting members is disposed at said downwardly convex portion of said upper plate.

11. The sole structure according to claim 1, wherein said lower plate has a wavy corrugation including a downwardly convex portion and an upwardly convex portion that are disposed alternately in a longitudinal direction, and wherein said one of said connecting members is disposed at said upwardly convex portion of said lower plate.

12. The sole structure according to claim 1, wherein said upper end extends outwardly sideways beyond a side edge of said lower plate adjacent to said base end.

13. The sole structure according to claim 2, wherein said upraised portion extends continuously longitudinally along said side edge portion.

14. The sole structure according to claim 2, wherein said upper plate has a wavy corrugation including at least two upwardly convex portions and one downwardly convex portion that are disposed alternately in a longitudinal direction, and wherein said upraised portion extends continuously along said side edge portion in said longitudinal direction at least along said two upwardly convex portions and said one downwardly convex portion.

* * * * *